United States Patent [19]

Willitts et al.

[11] Patent Number: 4,535,603

[45] Date of Patent: Aug. 20, 1985

[54] HIGHLY ENERGY EFFICIENT HEAT RECLAMATION MEANS FOR FOOD DISPLAY CASE REFRIGERATION SYSTEMS

[75] Inventors: Benjamin R. Willitts, Lawrenceville; Charles W. Klossman, Burlington, both of N.J.

[73] Assignee: Emhart Industries, Inc., Farmington, Conn.

[21] Appl. No.: 627,137

[22] Filed: Jul. 2, 1984

[51] Int. Cl.[3] ..... F25B 41/00

[52] U.S. Cl. ..... 62/196.4; 62/117; 62/238.6

[58] Field of Search ..... 62/196.4, 238.6, 117

[56] References Cited

U.S. PATENT DOCUMENTS

| | | | |
|---|---|---|---|
| 2,268,769 | 1/1942 | Newton | 62/196.4 X |
| 3,105,365 | 10/1963 | Harris et al. | 62/159 |
| 3,264,839 | 8/1966 | Harnish | 62/160 |
| 3,358,469 | 12/1967 | Quick | 62/196 |
| 3,905,202 | 9/1975 | Taft et al. | 62/152 |
| 3,926,008 | 12/1975 | Webber | 62/238.6 |
| 3,978,684 | 9/1976 | Taylor | 62/324 |
| 4,235,095 | 11/1980 | Liebermann | 73/19 |
| 4,328,682 | 5/1982 | Vana . | |

*Primary Examiner*—William E. Wayner
*Attorney, Agent, or Firm*—Sperry, Zoda & Kane

[57] ABSTRACT

A refrigeration system for food display cases is disclosed, having a heat reclamation coil, to which hot gas discharged by the system's compressors may be diverted in accordance with the conventional practice, to provide heat energy usable for heating and/or controlling the moisture content of the interior store area. An improvement in such heat reclamation systems is disclosed, in that the output of the heat reclaim coil is continuously sensed to determine whether it is in an all-liquid condition, or alternatively, a mixture of liquid and gas. If the former, valving is automatically operated to bypass the liquid output from the heat reclaim coil around the system's condenser to the liquid line downstream from the condenser, so that the heat reclaim coil functions as the system's condenser in these circumstances. If the output from the heat reclaim coil is a gas-liquid mixture, it is returned to the input side of the system's condenser to reduce the energy required for normal condenser operation.

22 Claims, 1 Drawing Figure

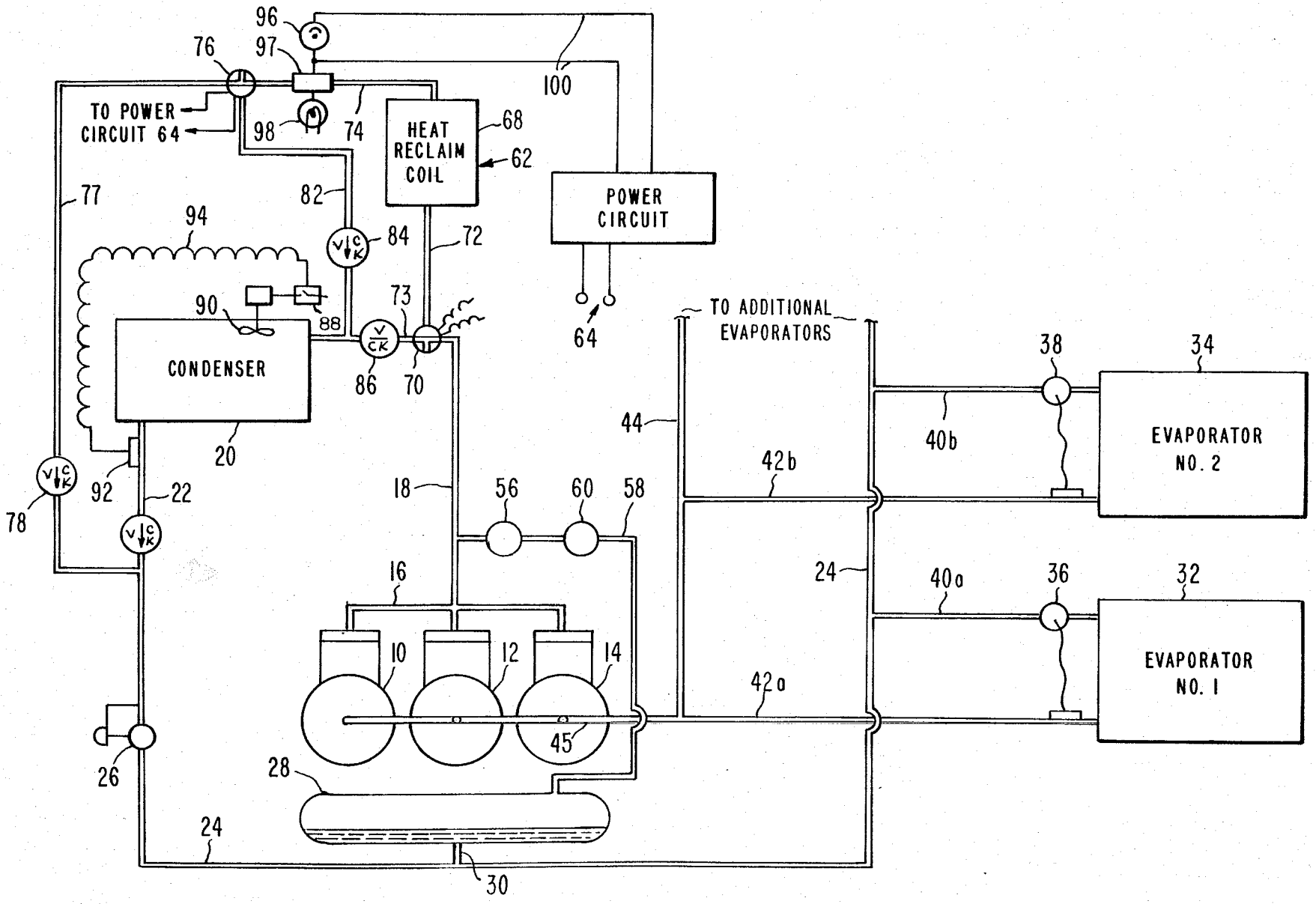
EVAPORATOR NO. 2
EVAPORATOR NO. 1
TO ADDITIONAL EVAPORATORS
POWER CIRCUIT
HEAT RECLAIM COIL
CONDENSER
TO POWER CIRCUIT 64

HIGHLY ENERGY EFFICIENT HEAT RECLAMATION MEANS FOR FOOD DISPLAY CASE REFRIGERATION SYSTEMS

BACKGROUND OF THE INVENTION

1. Field of the Invention

The present invention relates generally to refrigerating systems of the type used in supermarkets for refrigerating the contents of food display cases. The invention also relates, generally, to systems of the type described in which there is incorporated a heat reclamation circuit, used for the purpose of heating and/or controlling the moisture content of the store air.

In a more specific sense, the invention relates to those systems of the general type described wherein the known characteristic of the heat reclaim coil for condensing hot gases into the form of a liquid or a gas-liquid mixture is advantageously employed for condensing all or part of the hot gases discharged by the system's compressor means.

2. Description of the Prior Art

The provision of heat reclamation coils and associated piping, ducting, and controls, is well known in systems for refrigerating food display cases in supermarkets and similar establishments.

Typically, a heat reclamation sub-system is connected between the discharge side of the compressor or compressors of the system, and the condenser thereof. Under normal circumstances, the hot gas discharged by the compressors is piped directly to the condenser, where it is condensed to liquid form and thereafter directed to the receiver enroute to the evaporators, on in some cases directly to the evaporators themselves.

When the heat reclamation sub-system is to be brought into operation, the hot gas in the compressor discharge line is diverted through the heat reclaim coil, so that it can heat air in ducting for circulation of the heated air within the area of the store frequented by customers. The output of the heat reclaim coil is then directed to the inlet side of the condenser. Thus, in these circumstances, the heat reclaim coil becomes connected in series with the condenser, and as a desirable by-product of its main function, causes the hot gas directed thereto to be volatilized into a liquid or gas-liquid mixture, thereby aiding the condenser in the discharge of its assigned function.

While, thus, the known operational characteristic of the heat reclamation coil to function as a condenser has aided in reducing the energy requirements of the system's basic or main condenser, so far as is known no effort has been made heretofore to give maximum effect to the condensing function discharged by the heat reclaim coil when hot gases from the compressors are caused to flow through it. The main purpose of the present invention is to accomplish this, and to do it automatically.

SUMMARY OF THE INVENTION

To accomplish this end the present invention utilizes a heat reclaim coil sub-system which has all the characteristics of heat reclaim arrangements presently in use. Thus, it is arranged to respond to automatic thermostatic and/or humidostatic controls, to cause hot gas discharged by the compressors to be channeled through the heat reclaim sub-system. In this way, by heat exchange between the hot gas and the air in the enclosure in which the heat reclaim coil is mounted, the air is heated, and directed to the store interior. In cold weather, the air is used to heat the interior of the store. Even in summer, the heat reclaim coil may be automatically brought into operation for the purpose of aiding in control of humidity within the store interior.

The invention includes a main condenser bypass line extending from the output side of the heat reclaim coil past the main condenser, to a junction with the liquid line downstream from the main condenser. Mounted in this line is a sight glass, located in the path of a beam extending between a light source and a phototube. This sensor acts, if it "sees" clear liquid discharged by the heat reclaim coil, to operate a three-way valve in a manner to cause the liquid to bypass the main condenser and flow directly to the liquid line.

If, on the other hand, the sensing means sees "flashing", that is, a mixture of gas and liquid at the outlet side of the heat reclaim coil, it operates a three-way valve to direct the outflow from the coil to the input side of the main condenser, for further condensation to a completely liquid condition.

BRIEF DESCRIPTION OF THE DRAWING

While the invention is particularly pointed out and distinctly claimed in the concluding portions herein, a preferred embodiment is set forth in the following detailed description which may be best understood when read in connection with the accompanying drawings, in which:

The single FIGURE is a schematic representation of a refrigerating system for food display cases, having in association therewith the heat reclaim sub-system comprising the present invention.

DETAILED DESCRIPTION OF THE PREFERRED EMBODIMENT

The present invention can be employed with any of various refrigerating systems, so long as they are of the type that includes, basically, one or more compressors, a condenser to which hot gas is directed from the compressors for the purpose of being condensed into liquid refrigerant, a liquid line extending from the condenser to one or more evaporators, and a return line extending from the evaporators to the compressor means.

These components are essential to all refrigerating systems of the type used for refrigerating the contents of food display cases. In addition, such systems may also incorporate various other features: e.g., hot gas defrost piping, "cool" gas defrost, head pressure control means, etc.

The present invention is usable with any system that includes the basic essentials referred to above, without regard to whether or not it includes one or more of the additional features commonly used in such systems.

Thus, the basics of a typical refrigerating system are illustrated in the single FIGURE of the drawing, including a plurality of compressors 10, 12, 14 having a common hot gas discharge header 16 in communication with a hot gas discharge line 18 extending to the input side of condenser 20, from the output side of which extends the drop leg 22 of a liquid line 24. An inlet pressure regulating valve 26 is mounted in the liquid line, upstream from a surge-type receiver 28 the bottom of which is connected in communication with liquid line 24 as at 30.

Liquid line 24 extends to a bank of evaporators 32, 34 having expansion valves 36, 38 mounted in the evaporator inlet lines 40a, 40b, respectively. Extending from the evaporators are return lines 42a, 42b, respectively, communicating with a common refrigerant return line 44, connected to the suction manifold 45 of the compressors. Typically, the system may also include a receiver pressure control line 58, having mounted therein a solenoid valve 56 and a check valve 60 operative to, at times, permit the flow of hot gas directly from line 18 to the top portion of the receiver for increasing pressure within the receiver.

The operation of valve 56 can be controlled, for example, by means such as shown in Vana U.S. Pat. No. 4,328,682. In that patent, photoelectric cells are employed in the lines 40a, 40b, or alternatively, in line 24, operating in conjunction with sight tubes mounted in said lines, for the purpose of detecting "flashing", that is, the existence of a mixture of gas and liquid rather than a completely liquid refrigerant on the inlet side of the evaporators. Upon detection of such undesirable conditions, the photoelectric circuit, not shown in the present application, is operative to open valve 56 for the purpose of dumping hot gas into the receiver for elevating the head pressure sufficiently to eliminate the flashing condition.

The present invention also utilizes a photoelectric circuit, but for a different purpose.

Heretofore, it has been proposed to provide a heat reclaim sub-system in a refrigerating system of the general type described above, and it has also been proposed to provide power circuitry, as for example, circuitry needed in association with the above-mentioned photoelectric circuits to provide power for said circuits and for the valves controlled thereby. Such a power circuit has been designated as 64, and could be used not only for the purpose of providing power for the present invention, but also, for the purpose of providing any other electrical power needed in the refrigerating system, for example, power required by photoelectric circuits such as shown in the above-mentioned Vana patent.

THE INVENTION

The present invention has been generally designated as 62, and includes a power circuit 64 which can be used not only for the invention described herein, but also for such other improvements as, for example, the photoelectric sensing devices and valve operation of the above-mentioned Vana patent.

In accordance with the present invention there is provided a heat reclaim coil 68 to which hot gas can be diverted through a three-way valve 70 mounted in hot gas discharge line 18. The diverted hot gas flows to coil 68 through a heat reclaim coil inlet line 72. Within the coil, heat exchange occurs, whereby heat is transferred from the hot gas to the surrounding ambient. The air so heated is led through ducting or the like, not shown, for the purpose of heating the store interior or for use in controlling the moisture content of the store interior.

Valve 70 has two positions, in one of which it directs hot gas from the compressor discharge line 18 to the heat reclaim coil as described above. In its other position, illustrated in the drawing, valve 70 directs the hot gas to the input side of the main condenser 20, which typically is mounted on the roof of the store.

In a typical reclaim coil sub-system installation, the valving and the piping associated therewith are arranged to provide only two operational modes: first, when the heat reclaim coil is to be placed in use, it is connected in series with condenser 20, so that all hot gas flowing from the compressors is directed through the coil and thereafter to the input side of the condenser; and second, when the coil is not in use, all flow through the reclaim coil is prevented, with the hot gas flowing directly from the compressor to the condenser.

In accordance with the present invention, however, the heat reclaim coil has three modes: a first mode in which the coil is not in use, and in which flow therethrough is completely prevented, with hot gas flowing directly from the compressors to the condenser; a second, operational mode in which hot gas is diverted through the coil, is fully condensed to liquid form thereby and bypasses the condenser 20 completely with all flow of refrigerant through the condenser being prevented, and with the heat reclaim coil assuming the condensing function normally discharged by the main condenser 20; and a third, also operational mode in which hot gas is diverted through the heat reclaim coil and is condensed thereby to a part liquid-part gaseous form, with the outflow being directed to the input side of condenser 20 for further condensation to a fully liquid condition.

In accordance with the invention, the diversion of hot gas from the compressor discharge line 18 through line 72 to the heat reclaim coil, in both of the above-described operational modes, is effected automatically by thermostatic and/or humidostatic controls, not shown, associated with the three-way valve 70. Valve 70 would be of an electrical type, solenoid-operated between two positions in one of which it connects lines 18 and 72, and in the other of which it connects line 18 to the condenser inlet line 73. Such controls are well known to heat reclaim sub-systems and are well known to those working in the art. They are simply set to call for flow of the hot gas from the discharge line 18 to the reclaim coil whenever the temperature and/or humidity conditions in the store interior call for heat reclaim.

Within coil 68, the hot gas, by heat exchange with the surrounding ambient, may at times condense to a fully liquid form. Under other conditions, it may leave the heat reclaim coil as a mixture of gas and liquid. In either event, the outflow from coil 68 is directed to the heat reclaim coil outlet line 74. Within said line there is provided a three-way valve 76. Valve 76 is operable between one position in which it connects line 74 with a condenser bypass line 77 connected in communication with the liquid line downstream from the condenser. In its other extreme position, valve 76 connects the reclaim coil outlet line 74 with line 82 connected with the condenser inlet line 73.

In the bypass line 77 there is provided a check valve 78, so that whenever the condensed refrigerant is flowing from the outlet of condenser 20 into drop leg 22, it will be prevented from backing up into the bypass line 77. Conversely, when there is flow through the line 77 to the liquid line downstream from the condenser, said flow will be prevented from backing up into the condenser by the provision of a check valve 80 mounted in the drop leg 22 upstream from the connection of bypass line 77 to the liquid line.

A check valve 84 is also provided, in line 82. This is to prevent reverse flow in line 82 whenever hot gas is flowing directly from discharge line 18 through condenser inlet line 73 to the intake side of the condenser.

Whenever there is flow of the liquid-gas mixture through line 82 to the condenser inlet line 73, a check valve 86 mounted between valve 70 and the connection of lines 82 and 73 prevents reverse flow within the line 73, and requires that all of the flow coming through line 82 be directed into condenser 20.

Means is provided, in the invention, to maximize the conservation of electrical energy used by condenser 20. Typically, a condenser such as schematically depicted at 20 is provided with a plurality of fans. In the ordinary installation all but one of these fans cycle on thermostats, while the remaining fan operates continuously when the condenser is in its operational mode.

In accordance with the present invention, however, there is a further conservation of electrical energy, in that the end fan 90, which normally is the continuously running fan, is illustrated in association with a fan control switch 88, which itself is controlled by temperature sensitive bulb 92 mounted downstream from the condenser on the drop leg 22, upstream from the check valve 80. The thermostat is set to cycle the fan 88 off whenever the liquid leaving the condenser is at a predetermined temperature. Under other circumstances, the thermostat acts to close the switch 88, to operate the fan 90. When the condenser is being bypassed by flow directly through the bypass line 77, the absence of any flow from the condenser 20 past the thermostat 92 will act to cause the switch 88 to open and turn off the fan.

It is considered that the bulb 92 could be placed at the inlet side of the condenser 20, between valve 70 and check valve 86 along line 73, whenever the condenser 20 is being bypassed, to accomplish the same result of cycling the fan 90 off whenever condenser 20 is being bypassed. Bulb 92 is connected to switch 88 by tube 94.

In accordance with the invention, there is provided a phototube 96 and a light source 98. A light beam directed from source 98 to the phototube will be intercepted a sight glass 97 mounted in the heat reclaim coil outlet line 74, between said coil and the valve 76. The phototube 96 is activated only when the 3-way valve 70 is in the heat reclaim mode. The same suitable source of electrical power may activate both phototube 96 and power circuit 64.

The power circuit is arranged so that whenever the beam between source 98 and phototube 96 is cut off by partial or full opacity of fluid passing through the sight glass 97, valve 76 will be caused to operate from the position illustrated in the drawing, to its other position, in which it causes the fluid leaving coil 68 to flow through line 82 to the inlet side of the condenser 20, rather than to bypass the condenser by flowing through line 77.

OPERATION

Let it be assumed that the refrigerating system is operating normally, without a call for heat reclaim. In these circumstances, valve 70 will be in the position illustrated in the drawing, and hot gas discharged by the compressors will flow through line 18 directly to the intake side of the condenser 20 through the condenser inlet line 73. Flow of the hot gas into line 72 is blocked by the position of valve 70. Similarly, flow into the shunt 82 from line 73 is prevented by check valve 84.

In these circumstances, the hot gas is condensed in the normal way in the main condenser 20, to liquid form, leaving the condenser through the drop leg 22 for flow through liquid line 24 to the evaporators, after which the refrigerant returns to the compressors through the low side of the refrigerating system.

If, now, there is a call for heat reclaim, valve 70 is operated to its other position, in which it connects line 18 to line 72, and prevents flow of the hot gas into the condenser inlet line 73. In these circumstances, the hot gas flows through line 72 through the heat reclaim coil, which discharges its function of reclaiming heat from the hot gas passing therethrough, for heating the store interior and/or for moisture control purposes.

In discharging this function, coil 68 operates as a condenser, condensing the hot gas passing therethrough either to a fully liquid form or to a mixture of gas and liquid, depending upon the demands for heat reclaim made thereon, and the temperature conditions under which the heat reclaim coil is required to operate. In any event, at times the refrigerant will exit coil 68 through line 74 in a fully condensed, completely liquid condition. In these circumstances, there is no need for the main condenser 20, since all of the refrigerant in the refrigerating system that has left the compressors, has now been condensed to a fully liquid condition. Accordingly, the flow through sight glass 97 will be completely clear. The "electric eye" comprising phototube 96 and light source 98 will thus "see" that the refrigerant exiting the coil 68 has been fully condensed, and will cause valve 76 to be operated to the position shown in the drawing, in which the condensed refrigerant is caused to flow directly from line 74 to bypass line 77, completely bypassing condenser 20 and flowing directly into the liquid line downstream from the condenser.

At other times, the refrigerant exiting the coil 68 may be only partially condensed, that is, may have gas bubbles in it. In these circumstances, the flow through sight glass 97 will have enough opacity to intercept the light beam between phototube 96 and light source 98. As a result, since the photoelectric means cannot under these circumstances "see" through the sight glass, valve 76 is operated to its other extreme position, in which it now connects the heat reclaim outlet line 74 with the shunt 82 and blocks off the bypass 77.

The partially condensed mixture of gas and liquid will now flow through shunt 82 to the inlet side of condenser 20, which will act to fully condense the refrigerant to a liquid form for passage through the liquid line 24 to the evaporators.

The partial condensation of the refrigerant within coil 68, in these circumstances, aids the condenser 20 in the discharge of its assigned function, thus reducing the energy requirements for the condenser.

It will be seen that due to the construction illustrated and described, it is not necessary to add to the normal quantity of refrigerant needed for the purpose of charging the refrigerating system. Whatever refrigerant is necessary for flow through the condenser 20 under normal operating conditions, is sufficient when the system is in a heat reclaim mode, since all flow is diverted through the heat reclaim coil, and is condensed, either in the heat reclaim coil alone, or alternatively in the coil 68 and condenser 20 operating as series-connected condensers.

It may also be noted that whenever the heat reclaim coil is blocked off, three-way valve 70 is of a type that will bleed off any liquid remaining within the coil 68, back into the system even though the valve 70 is positioned to block flow from line 18 into the line 72. By the same token, valve 76 is also of the type that will bleed liquid back into the system from a passage blocked thereby. Valves of this type are well known, and are desirable in that they return all refrigerant to the system from portions of the system that are not, at a particular point in time, operational as flow passages.

While particular embodiments of this invention have been shown in the drawings and described above, it will be apparent, that many changes may be made in the form, arrangement and positioning of the various elements of the combination. In consideration thereof it should be understood that preferred embodiments of this invention disclosed herein are intended to be illustrative only and not intended to limit the scope of the invention.

We claim:

1. In a refrigerating system including at least one compressor in which refrigerant is compressed into the form of a hot gas, a condenser, hot gas discharge line means extending from the compressor to the condenser, at least one evaporator, a liquid line extending from the condenser to the evaporators, and suction line means extending from the evaporator to the compressor, the improvement comprising:

(a) a heat reclaim coil;

(b) means for, at times, diverting the flow of hot gas from the discharge line means to the coil for heat-exchange with the surrounding ambient and at least a partial condensation of the refrigerant within the coil; and (c) means for bypassing the outflow of refrigerant from the coil around the condenser to the liquid line whenever said refrigerant has been condensed fully to a liquid form within the coil and for, alternatively, directing said outflow to the condenser for further condensation whenever the refrigerant exits the coil as a mixture of gas and liquid.

2. In a refrigerating system the heat reclaim improvement of claim 1 wherein the means for diverting the flow of gas to the heat reclaim coil is a three-way valve operable between a first position connecting the discharge line means to the condenser, and a second position connecting the discharge line means to the heat reclaim coil.

3. In a refrigerating system the heat reclaim improvement of claim 1, in which the last-named means comprises a valve operable between a first position in which it connects the coil to the liquid line to bypass the outflow from the coil around the condenser, and a second position in which it connects the coil to the condenser for passage of the coil outflow through the condenser.

4. In a refrigerating system the heat reclaim improvement of claim 2, said last named means further including means for sensing the extent to which the outflow from the reclaim coil has been condensed by the coil, and for operating the valve to its respective positions according to the sensed condition of the outflow.

5. In a refrigerating system the heat reclaim improvement of claim 4, wherein the sensing means is adapted to detect the extent, if any, to which gas bubbles are present in the outflow from the heat reclaim coil as signifying incomplete condensation of said outflow, and responds to the detected condition to effect operation of the valve.

6. In a refrigerating system the heat reclaim improvement of claim 5, wherein the sensing means is adapted to cause operation of the valve to its first position in the absence of bubbles in said outflow signifying complete condensation of the outflow to a liquid form, and is adapted to cause operation of the valve to its second position in the presence of said bubbles signifying a mixture of gas and liquid.

7. In a refrigerating system the heat reclaim improvement of claim 6 wherein the sensing means comprises a sight glass mounted upstream from the valve, photoelectric means mounted in position to direct a light beam through the glass, and an electrical circuit adapted to effect operation of the valve to its second position responsive to interception of the light beam signifying the presence of gas bubbles in the outflow from the heat reclaim coil.

8. In a refrigerating system including at least one compressor in which refrigerant is compressed into the form of a hot gas, a condenser, hot gas discharge line means extending from the compressor to the condenser, at least one evaporator, a liquid line extending from the condenser to the evaporators, and suction line means extending from the evaporator to the compressor, the improvement comprising:

(a) a heat reclaim coil having an inlet and an outlet;

(b) a heat reclaim coil input line extending from a junction with the hot gas discharge line means upstream from the condenser, to the coil inlet;

(c) a common outflow line extending from the coil outlet;

(d) a bypass line extending from the common outflow line past the condenser to a junction with the liquid line downstream from the condenser;

(e) a shunt line extending from the common outflow line to a junction with the hot gas discharge line means, disposed between the condenser and the junction of the heat reclaim coil inlet line and the hot gas discharge line means;

(f) means for, at times, diverting the flow of hot gas into the coil through the coil inlet line from the hot gas discharge line means, for heat exchange with the surrounding ambient and at least a partial condensation of the refrigerant within the coil; and (g) means for directing the outflow of refrigerant from the coil at times through the bypass and at other times through the shunt line responsive to the extent to which the refrigerant flowing through the common outflow line has been condensed within the coil.

9. In a refrigerating system the heat reclaim improvement of claim 8 wherein the means for diverting the flow of hot gas into the coil is a three-way valve operable between first and second positions in which it connects the hot gas discharge line means to the condenser and to the coil, respectively.

10. In a refrigerating system the heat reclaim improvement of claim 9 wherein said valve is arranged to be responsive at least to the temperature within an area that is to be warmed by air heated by the heat reclaim coil.

11. In a refrigerating system the heat reclaim improvement of claim 9 wherein the coil outflow directing means includes a second three-way valve mounted at the juncture of the common outflow line with the bypass and shunt lines.

12. In a refrigerating system the heat reclaim improvement of claim 11, wherein the outflow directing means further comprises means mounted upstream from the second named valve, and adapted to sense the extent to which the refrigerant has been condensed within the heat reclaim coil, said sensing means adapted for operating the second-named valve to first and second positions communicating the common outflow line with the bypass and shunt lines respectively.

13. In a refrigerating system the heat reclaim improvement of claim 12 in which the sensing means effects operation of the second-named valve to its first and second positions, respectively, according to whether the outflow from the coil is fully or partially condensed to a liquid form.

14. In a refrigerating system the heat reclaim improvement of claim 13 wherein the sensing means includes a photoelectric device adapted to sense whether the refrigerant in the common outflow line is in a clear, fully liquid condition.

15. In a refrigerating system the heat reclaim improvement of claim 14 wherein said device includes a sight glass mounted in the common outflow line upstream from the second-named valve.

16. In a refrigerating system the heat reclaim improvement of claim 15 wherein the sensing means further includes a phototube and a light source arranged to produce a light beam projected through the sight glass.

17. In a refrigerating system the heat reclaim improvement of claim 16 wherein the light beam is adapted to be broken by any condition assumed by the refrigerant outflow from the coil that is less than a clear, fully condensed liquid.

18. In a refrigerating system the heat reclaim improvement of claim 8 further including means for preventing reverse flow in the liquid line, bypass line, hot gas discharge line means, and shunt line.

19. In a refrigerating system the heat reclaim improvement of claim 18 wherein the several reverse-flow-preventing means comprise a plurality of check valves.

20. In a refrigerating system the heat reclaim improvement of claim 1, further including a normally on fan in association with the condenser, and means for cycling the fan to off position whenever the refrigerant outflow is bypassed around the condenser.

21. In a refrigerating system the heat reclaim improvement of claim 20 wherein said last named means comprises a thermostatic switch means.

22. In a refrigerating system the heat reclaim improvement of claim 21 wherein the switch means includes a temperature sensor adapted to sense the temperature within the liquid line between the condenser and the point of entry of the bypassed flow into the liquid line.

* * * * *